United States Patent [19]

Galster

[11] Patent Number: 4,533,134

[45] Date of Patent: Aug. 6, 1985

[54] MECHANISM FOR THE LATERAL ALIGNMENT OF SHEETS IN A PRINTING MACHINE

[75] Inventor: Hans-Peter Galster, Seligenstadt, Fed. Rep. of Germany

[73] Assignee: M.A.N.-Roland Druckmaschinen Aktiengesellschaft, Fed. Rep. of Germany

[21] Appl. No.: 466,878

[22] Filed: Feb. 16, 1983

Related U.S. Application Data

[63] Continuation-in-part of Ser. No. 451,255, Dec. 20, 1982, abandoned.

[30] Foreign Application Priority Data

Dec. 18, 1981 [DE] Fed. Rep. of Germany ..... 3150169

[51] Int. Cl.[3] ..... B65H 9/16

[52] U.S. Cl. ..... 271/240; 271/250; 271/238

[58] Field of Search ..... 271/238, 239, 240, 250, 271/253, 255, 236, 237, 248, 249, 252

[56] References Cited

U.S. PATENT DOCUMENTS

| | | | |
|---|---|---|---|
| 2,798,720 | 7/1957 | Morse | 271/252 |
| 3,860,233 | 1/1975 | Wiase | 271/250 X |
| 4,211,399 | 7/1980 | McGowan | 271/250 X |
| 4,260,149 | 4/1981 | Melzer | 271/250 X |
| 4,264,068 | 4/1981 | Melzer | 271/250 |

*Primary Examiner*—Richard A. Schacher

*Attorney, Agent, or Firm*—Leydig, Voit, Osann, Mayer & Holt, Ltd.

[57] ABSTRACT

A device for registering a sheet with a side stop at either one of the opposite lateral edges of a feed table in a printing press. The device includes a housing having a top surface which is flush with the feed table. A suction head is flushly recessed in the surface of the housing and mounted in a slide in the housing for limited reciprocating movement. The housing is shiftable between alternative working positions at the respective lateral edges of the feed table. For driving the suction head timed with the arrival of a sheet, a drive shaft is provided in the housing having a pair of face type cams spaced axially from one another cooperating with a cam follower which is secured to the suction head in a position between the cams. Springs are provided for biasing the suction head in opposite directions. A shiftable yoke selectively engages the springs with the suction head so that the cam follower engages a selected one of the cams. A rotary value on the drive shaft applies suction to the head timed with the movement of the head toward the adjacent side stop. The cams are in mirror image, that is, 180° out of phase, so that the sheet moves into contact with one of the side guides, with application of suction, timed with the feeding of the sheet on the feed table regardless of which side stop is being employed. In a modified form of the invention application of suction to the sheet is followed by a puff of compressed air.

9 Claims, 7 Drawing Figures

MECHANISM FOR THE LATERAL ALIGNMENT OF SHEETS IN A PRINTING MACHINE

This application is a continuation-in-part of application Ser. No. 451,255, filed Dec. 20, 1982 now abandoned.

DESCRIPTION OF THE INVENTION

In a sheet-fed printing press sheets are fed in succession on a feed table into a pickup position accurately determined by a front stop and a side stop, as disclosed, for example, in prior U.S. Meizer Pat. No. 4,260,149. The side stop, which achieves "side lay", may be located either on the right or left hand edge of the table. For example, when printing on both sides of a single sheet it may be necessary to provide a side stop in both the right and left hand positions for printing the respectively opposite sides of the sheet to keep the margins on the opposite sides of the sheet in register with one another. For this reason practically all printing machines are provided with two separate and complete lateral alignment mechanisms including means for urging the sheet into engagement with the appropriate side stop.

Mechanisms are known which are of adjustable construction, i.e., capable of working at both lateral edges of the feed table. An example of such a mechanism is shown in German Pat. No. 1,950,305 in which the mechanism is provided with exchangeable top parts, one part being constructed as a pusher and the other as a puller. The disadvantage of such construction is that the lateral alignment mechanism must be reconstructed when making a changeover from pulling to pushing. Another disadvantage is that two of such mechanisms must be provided.

Another mechanism intended for the same purpose is disclosed in German Pat. No. 1,278,449 in which separate suction valves are provided at the right and left hand sides of the feed table. These valves are inter-coupled and are driven jointly by a cam. To change over from right-hand to left-hand "lay", the sheet stop and a sheet driver secured to the suction valve must be switched. This mechanism also has the disadvantage that considerable conversion work is necessary for switching between right-hand and left-hand lay.

It is an object of the present invention, in contrast, to provide a single mechanism which is capable of producing lateral alignment of a sheet either along its right-hand or its left-hand edge without any reconstruction or conversion effort and by the simple expedient of shoving the aligning assembly either to one side or the other of the feed table and plugging in the appropriate side stop.

It is another object to provide a lateral alignment mechanism capable of operating at either side of the feed table and which includes a suction head to which suction is applied during the outward stroke but which does not require any adjustment or retiming to adapt the device to work along the opposite side of the table. In one of the aspects of the invention it is an object to provide a lateral alignment mechanism which applies suction accurately timed with respect to the feeding of a sheet and followed, in sequence, by an accurately timed puff of air for releasing the sheet from the suction without adjustment and without care or attention on the part of the operator other than that required to throw over of a control arm in the direction of the active side stop.

It is, in general, an object of the invention to provide a lateral alignment mechanism which is capable of servicing both the right and left hand edges of a feed table but which is of economical construction, costing only slightly more than an alignment mechanism which is capable of handling alignment along only one side of the table.

Other objects and advantages of the invention will become apparent upon reading the attached detailed description and upon reference to the drawings in which.

While the invention has been described in connection with certain preferred embodiments, it will be understood that there is no intention to limit the invention to the particular embodiments shown, but it is intended, on the contrary, to cover the various alternative and equivalent constructions included within the spirit and scope of the appended claims.

Figure 1:
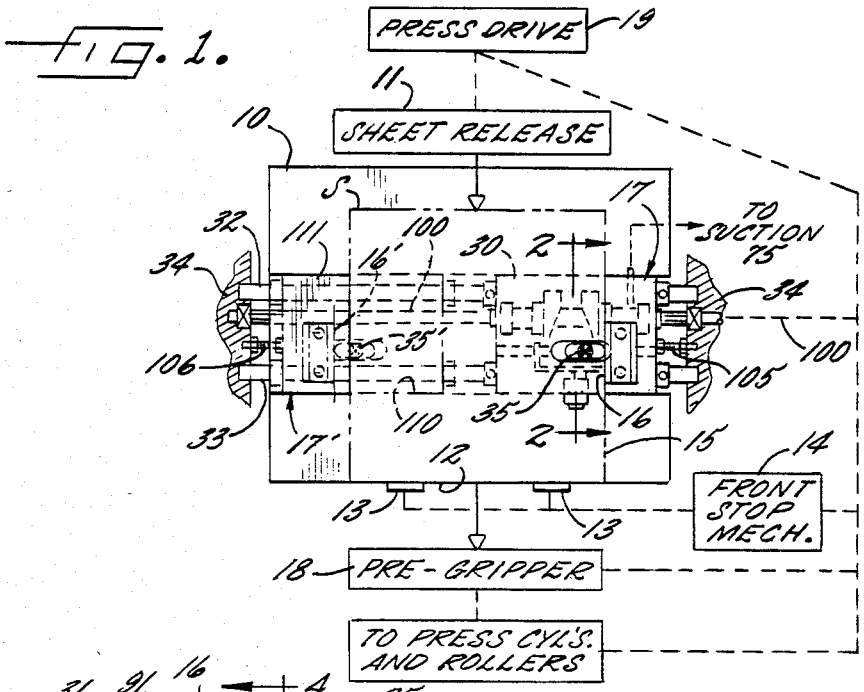
FIG. 1 shows, in plan view, a feed table to which the present invention has been applied, with the drive and driven elements being shown diagrammatically.
Figure 2:
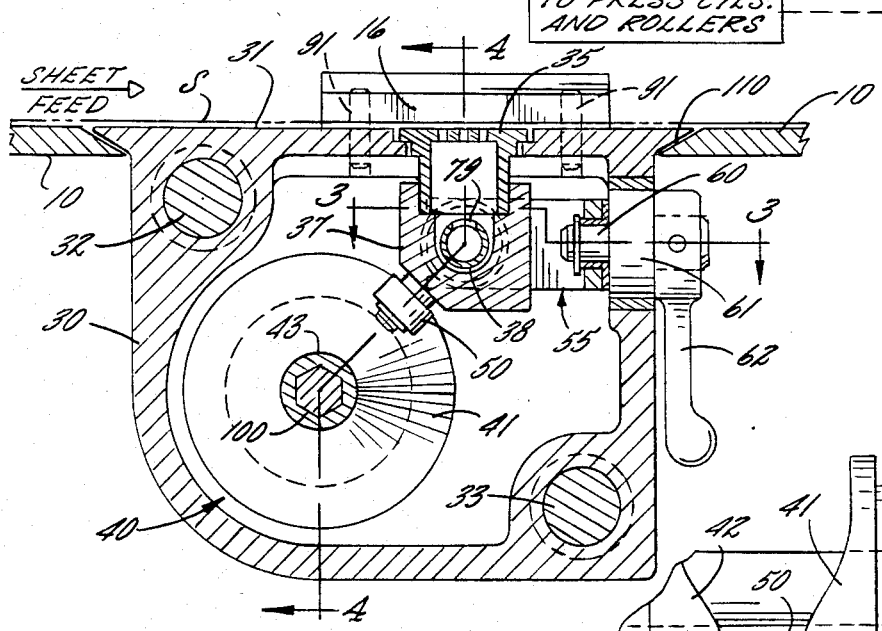
FIG. 2 is a view of the registering assembly looking along line 2—2 of FIG. 1.

Turning now to FIG. 1, there is shown, diagrammatically, in plan view, a feed table 10 at the input of a sheet-fed lithographic press unit. A sheet, indicated at S, is released by a sheet-depositing, or release, mechanism 11 with forward velocity in the direction of the arrow, the velocity being sufficient so that the leading edge 12 of the sheet S carries to a front stop 13 which generally, as shown, has two portions which are coupled together and which are moved between interposed and retracted positions by a front stop mechanism 14. The sheet follows a path across the table such that the lateral edge 15 of the sheet passes adjacent the side stop 16. Associated with the side stop is a side lay, or side-registering, assembly 17 constructed in accordance with the present invention and which will be described in detail. When the sheet is in registered engagement with the front and side stops 13, 16, it is engaged by a pre-gripper mechanism 18, per se well known to those skilled in the art, which passes the sheet to the impression cylinder of the press unit (not shown) where printing takes place. In order to ensure accurate synchronism of the release, register and gripping operations, all of the mechanical elements are directly coupled to the press drive 19. Thus, sheets may be fed across the table, registered, and removed at a high cyclic rate.

In accordance with the present invention, the lateral alignment mechanism is shiftable between the position indicated at 17, as shown by solid lines in FIG. 1 to a position 17' along the opposite edge of the feed table where it cooperates with an alternate side stop 16' as shown in phantom.

Turning to the details of the alignment mechanism 17, it may be noted, in FIGS. 1–4, that it includes a more or less rectangular housing 30 having a top surface 31 which is flush with the table 10 and which is supported, for sliding movement, on lateral way bars 32, 33 which are telescopingly received in holes in the housing and which are mounted, at their ends, in the frame members 34 of the press (especially FIG. 1). Flushly recessed in the surface 31 of the housing 30 is a suction head 35 having a set of openings 36. The suction head is mounted upon a slide 37 which is reciprocatingly mounted upon a tube 38, the ends of which are enclosed by plugs 39.

Figure 3:
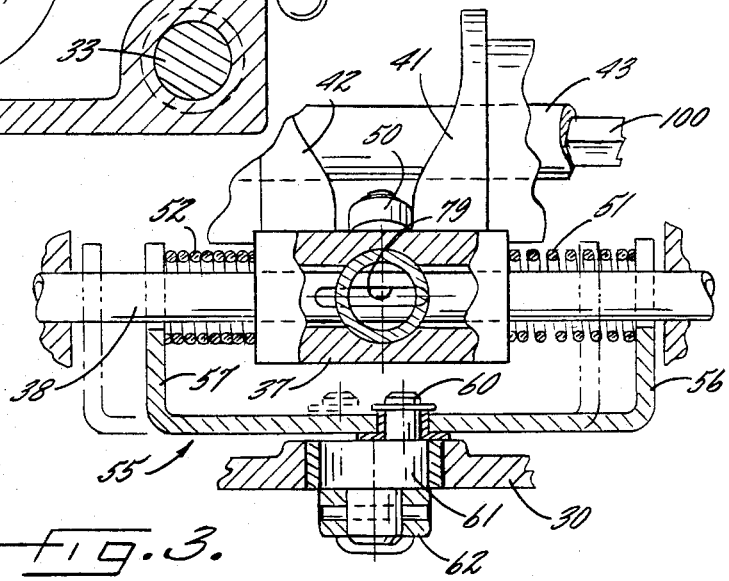
FIG. 3 is a fragmentary section as viewed along line 3—3 in FIG. 2.

For driving the slide 37, and the suction head 35 which it carries, back and forth through a limited amplitude, a first and second alternative driving means is provided relatively out of phase by 180°. The driving assembly, indicated at 40, includes first and second cams 41, 42 both mounted upon a drive shaft 43 journalled in bearings 44, 45 mounted in the housing. The cams 41, 42, mounted in opposed relation on the shaft, are of the "face" type constructed to be mirror images of one another having opposed "high" regions 46, 47 and opposed "low" regions 48, 49. Secured to the slide 37 in a position between the cams is a cam follower 50 in the form of a roller mounted upon a shaft 51. In accordance with one of the important features of the present invention, the cam follower 50 is biased against the face of either cam 41 or cam 42, for driving of the suction head, depending upon which side of the feed table the assembly is used. For providing bias to the slide 37 in opposite directions, two springs 51, 52 are used, each spring being telescoped over the tube 38 and bearing, at its inner end, against the slide. For selectively activating one of the springs 51, 52 a yoke is used which spans, and alternatively presses against, the outer ends of the springs 51, 52. As illustrated in FIG. 3, the yoke, generally indicated at 55, is of "U" shape having opposed side legs 56, 57. The yoke is mounted upon an eccentric 60 at the end of a shaft 61 having an operating handle 62. By manually throwing the handle 62 between alternate positions, as indicated by the phantom lines, either the spring 51 or the spring 52 may be engaged causing the cam follower 50 coupled to the suction head 35 to resiliently engage, or bottom upon, either the cam 41 or the cam 42.

Figure 4:
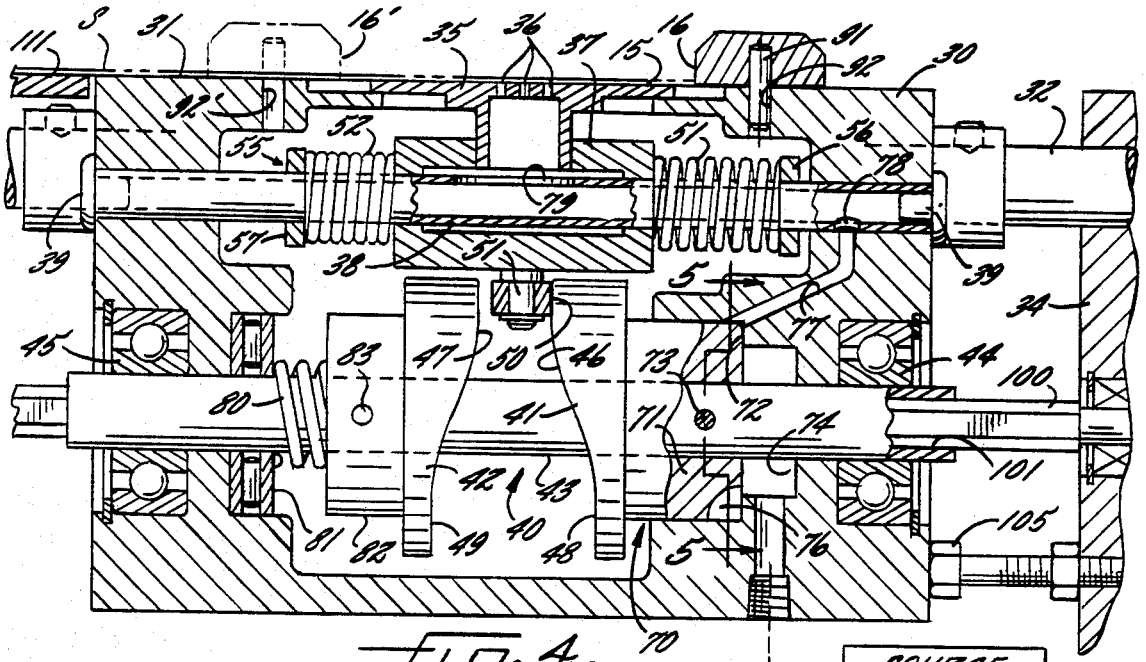
FIG. 4 is a sectional view, taken axially, and looking along line 4—4, in FIG. 2.

As further illustrated in FIG. 4, the yoke 55 is set to compress the spring 52 against the slide 37 thereby bringing the cam follower 50 against the face of the cam 41 so that the head 35 is phased to urge the lateral edge 15 of sheet in the direction of the side stop 16 timed with the arrival of the sheet.

Figure 5:
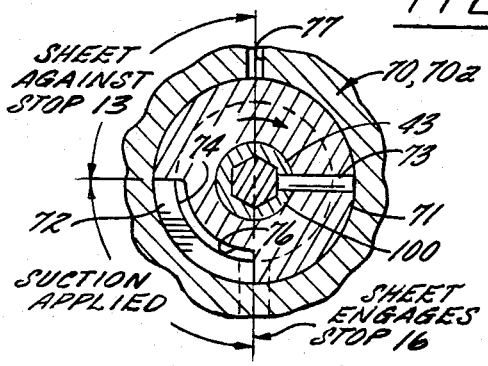
FIG. 5 is a fragmentary cross-section showing the suction valve as viewed along line 5—5 of FIG. 4.

For the purpose of applying suction to the head at the same time that the head moves in the direction of the side stop, a rotary valve is provided on the drive shaft 43 cyclically connecting the head, via its supporting tube 38, to a source of suction. Thus, mounted upon the shaft 43 is a valve 70 which consists of an annular rotor 71 bearing against a fixed end surface 72. The rotor is secured to the shaft 43 by means of a drive pin 73. The rotor forms one wall of an annular suction chamber 74 which is connected to a source of suction 75. Formed in the rotor 71 is a peripheral port, or pocket, 76 (See FIG. 5). For providing communication between the pocket 76 and the slide-supporting tube 38, a suction conduit 77 is used. The wall of the tube 38 is, in turn, ported, at 78, to provide communication with the head 35.

In accordance with one of the more detailed features of the invention the rotor 71 is urged into sealing engagement with the end surface 72 by a constantly effective biasing spring surrounding the shaft 43, the biasing spring exerting a force which greatly exceeds the force of the selector springs 51, 52. Such constant biasing spring, indicated at 80, has one end seated upon a thrust bearing 81 and the other end seated upon a collar 82 which is secured to the shaft by a pin 83. Preferably the cam 41 is integral with the rotor 71 and the cam 42 is integral with the collar 82. Thus, the force axially exerted by the spring 80 seats the rotor 71 intimately against the fixed end surface 72 so that leakage is minimized, regardless of which of the springs 51, 52 is in use.

In carrying out the present invention, means are provided for alternative mounting of the side stop at the respective lateral edges of the feed table. This is accomplished in the illustrated mechanism by providing means for mounting the side stop 16 on the same housing 30 which includes the suction head, with the side stop being mountable on the housing on respectively opposite sides of the suction head. Thus, referring to FIGS. 2 and 4, the side stop 16 is mounted by pins 91 which fit into holes 92 at the right-hand side of the head. A corresponding set of holes 92', at the opposite side of the head 35, mounts the side stop when it occupies its alternative position 16'. Thus as best seen in FIG. 1, the side stop 16 is utilized when the working position of the suction head is at the right-hand side of the table and the same side stop is used, in position 16', when the suction head occupies a working position at the left-hand side of the table.

In accordance with one of the further aspects of the present invention the drive shaft 43, which is journalled in the housing 30, is of hollow construction. Telescopingly received in it is a main drive shaft which is journalled in the frame and which is keyed to the drive shaft 43 for maintaining a drive connection in both of the alternative shifted position of the housing. Thus, referring to FIGS. 4 and 5, the drive shaft 43 will be seen as telescoped over the main drive shaft 100 which is coupled to the press drive 19. The drive shaft 100 is preferably of hexagonal cross section keyed to a mating hexagonal opening 101 in the shaft 43. Limit stops 105, 106 in the path of shifting movement of the housing 30 accurately determine its respective working positions.

Figure 7:
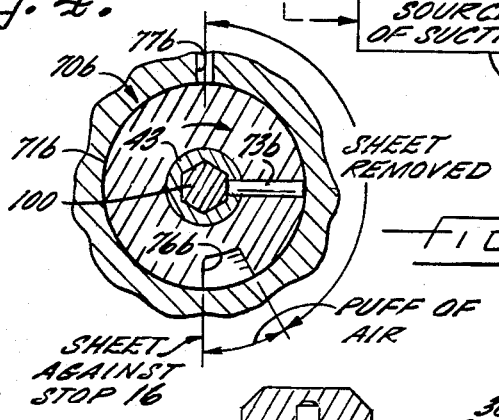
FIG. 7 is a view similar to FIG. 5 but showing the compressed air valve, as viewed along line 7—7 in FIG. 6.
Figure 6:
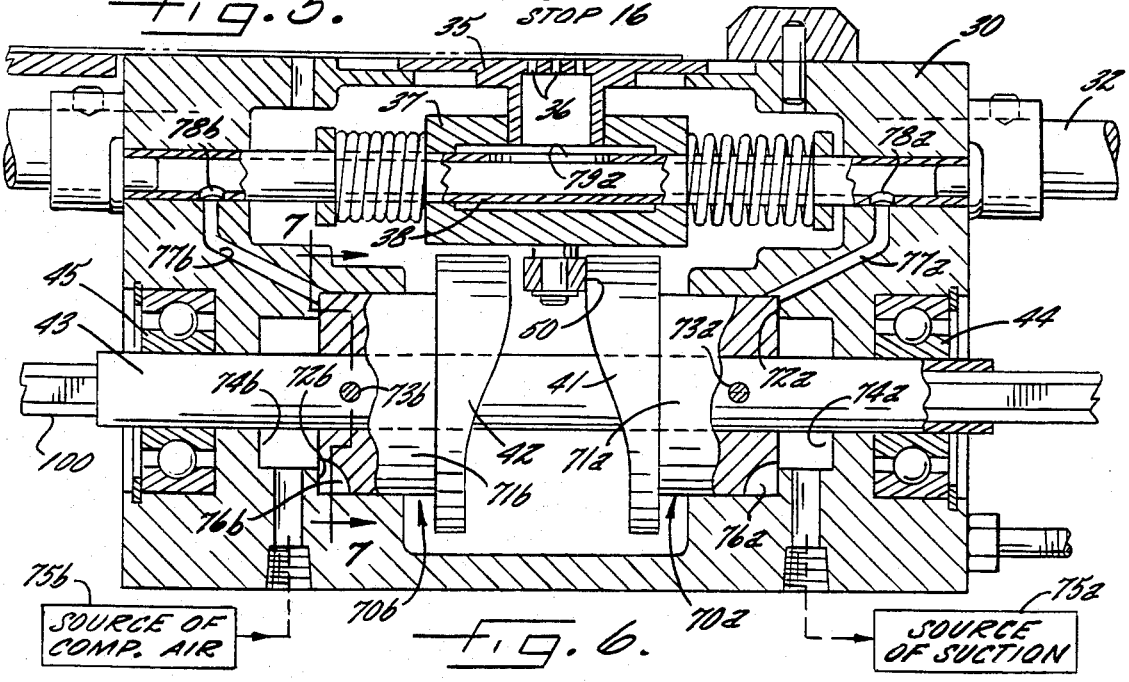
FIG. 6 is a view similar to FIG. 5 but showing a modified embodiment of the invention.

In accordance with one of the more detailed features of the present invention means are provided for coupling the suction head to a source of compressed air so that a puff of air is applied to the sheet following application of suction to release the sheet from the effect of the suction to insure that the sheet is not dislodged from its registered position on the table and to enable the sheet to be more promptly removed from the table. Such an arrangement is shown in FIGS. 6 and 7 in which mechanical elements of the valve corresponding to the first embodiment are denoted by corresponding reference numerals with the addition of subscript a. This structure includes, in addition, a second valve **70*b* formed of an annular rotor 71*b* on shaft 43 and which seals against a surface 72*b* , the rotor being secured to the shaft by means of a pin 73*b*. Adjacent the rotor is a compressed air chamber 74*b* which is in communication with a source of compressed air 75*b*. The rotor is ported at 76*b* to provide communication via a passageway 77*b* between the compressed air chamber 74*b* and the tube 38 which guides the slide 37**.

In operation, a sheet, released by the mechanism 11, travels forwardly and downwardly along the table 10 in the direction of the front stop 13. As the sheet is about to engage the front stop, the suction head 35, moving in the direction of the side stop 16, applies suction to the sheet urging it into engagement with the side stop, resulting in accurate side registration of the sheet. The degree of suction is sufficiently light so that after the edge of the sheet engages the side stop overtravel of the suction head may occur without crushing the engaged edge of the sheet. When register has been achieved and before the suction head 35 begins its reverse movement, the suction is cut off by the valve 70 (70*a*) and a short puff of air is applied through the openings 36 of the head by the compressed air valve 70*b*, thereby releasing the sheet from the effect of suction. This not only enables the sheet to be promptly removed from the table by the pregripper 18 but it absolutely ensures against the possibility that residual vacuum in the head may tend to pull the sheet away from its register position against the side stop as the head reverses its movement.

In order to accommodate the sliding of the mechanism 17 between its alternate positions 17, 17', the feed table 10 is preferably made into two separated portions providing a central laterally extending slot 110 which is occupied by a flush filler piece 111 (FIG. 1) which occupies, and bridges, the space which is vacated by the shifting movement of the housing and which therefore exists on the "inner" side of the housing depending upon whether the device described is being used in its right or left-hand position. Provision of the filler piece 111, and the support thereof flush with the table top, restores the integrity of the table.

It is to be particularly noted that since the alternate driving means for the suction head, that is, the cams 41, 42 are out of phase by 180° as far as the cam "throw" is concerned, no change or adjustment need be made in the timing or sequence of the application of suction and pressure to the suction head depending upon whether the mechanism occupies its right or left-hand position.

The term "slide" as used herein is intended to be a broad term including any means for guiding the suction head through its limited range of reciprocation. The term "cam follower", while specifically applicable to the single cam follower element 50, is not limited to such single element, and it will be appreciated by one skilled in the art that, if desired, the two cams 41, 42 may both be turned inside out, that is, arranged back to back, for alternative cooperation with respective sections of a cam follower which may, in such event, consist of separate rollers 50 spaced axially outwardly from the respectively outwardly facing cam surfaces, without departing from the present invention.

The side stop 16 is shown as being secured by pins 91, 91' in its alternate positions 16, 16'. Such mode of attachment has been shown for the sake of simplicity and it is a simple matter to adjust the end stops 105, 106 for accurate adjustment of side lay at the respective sides of the feed table. However, it will be understood that fixed stops 105, 106 may be used if the side stop 16 itself is laterally adjustable with respect to the housing. It will also be apparent to one skilled in the art that the stop 16 may be mounted, if desired, on the table 10, in alternate positions adjacent the suction head, rather than on the housing 30.

I claim:

1. A device for registering a sheet at either one of the opposite lateral edges of a feed table in a printing press having a frame and a press drive and having means timed with the drive for releasing the sheets to the feed table for feeding one-by-one, the combination comprising a housing having a top surface flush with the feed table, first and second means for alternative mounting of a side stop at the respective lateral edges of the feed table, a suction head flushly recessed in the surface of the housing, means including a slide in the housing for mounting the suction head for limited reciprocating movement toward and away from the side stop mounting means, means mounting said housing for shifting between alternative working positions at the respective lateral edges of the feed table for the purpose of utilizing the suction head in the respective working positions for the selective alignment of a sheet at the respective lateral edges, first and second means carried by and shiftable with said housing between said respective working positions for alternatively driving of the suction head in its respective working positions, the alternative driving means being relatively out of phase by 180° to produce movement of the sheet into contact with the adjacent one of the side guides timed with the feeding of sheet on the feed table, and means for selecting the alternative driving means.

2. The combination as claimed in claim 1 in which the alternative driving means for the suction head is in the form of a pair of driven cams with cooperating cam follower means on the suction head, the selecting means being effective to bring the cam follower means into engagement with a selected one of the cams.

3. The combination as claimed in claim 1 in which the alternative driving means for the suction head is in the form of a pair of face type cams spaced axially from one another in mirror image relation and driven in unison together with a cam follower secured to the suction head in position between the cams, the selecting means including means for biasing the suction head so that the cam follower engages a selected one of the cams.

4. The combination as claimed in claim 1 in which the alternative driving means for the suction head is in the form of a pair of face type cams spaced axially from one another on a common drive shaft and in mirror image relation together with a cam follower secured to the suction head and positioned between the cams, first and second springs for biasing the suction head in opposite directions, the selector means including a shiftable yoke for selectively engaging the springs with the suction head.

5. The combination as claimed in claim 1 in which the alternative driving means for the suction head includes a drive shaft having two cams spaced thereon, the suction head having a cam follower positioned between the cams, a source of suction, a rotary valve on the drive shaft including a rotor in endwise engagement with a fixed surface, the drive shaft having a spring for constantly biasing the shaft endwise to maintain the rotor in sealing engagement with the fixed surface, means including a selector spring for biasing the suction head so that the cam follower engages a selected one of the cams, the constant biasing spring having a force which greatly exceeds the force of the selector spring so that sealing engagement is maintained regardless of the selected condition of the selector spring.

6. The combination as claimed in claim 1 in which the alternative driving means for the suction head includes a hollow drive shaft journalled in the housing, a main drive shaft journalled in the frame extending through and keyed to the hollow drive shaft for maintaining a driving connection with the housing in both of its alternative shifted positions.

7. The combination as claimed in claim 1 in which the alternative driving means for the suction head includes a drive shaft journalled in the housing having two cams spaced thereon, the suction head having a cam follower positioned between the cams, a source of suction, a first rotary valve on the drive shaft for periodically connecting the suction head to the source of suction timed with the movement of the head toward the adjacent one of the side stops, a source of compressed air, a second rotary valve on the drive shaft for periodically connecting the suction head to the source of compressed air for subsequently providing a puff of air to release the sheet from the effect of the suction, the selector means including a spring for selectively biasing the suction head so that the cam follower engages a selected one of the cams, the cams being in mirror image so that the head is subjected to suction and pressure in the same sequence in both of the alternative positions of the housing.

8. The combination as claimed in claim 1 in which the first and second means for alternative mounting of the side stop are provided on the housing itself on respectively opposite sides of the suction head.

9. The combination as claimed in claim 1 in which the feed table has a transverse slot dimensioned to accommodate the housing in its shifting movement between its alternative working positions, and a filler piece, flush with the table, for occupying and bridging the space vacated by said housing in its shifting movement to restore the integrity of the table.

* * * * *